US005937443A

United States Patent [19]

Kageyama et al.

[11] Patent Number: 5,937,443

[45] Date of Patent: Aug. 17, 1999

[54] SHOCK ABSORBING AID FOR HUMAN BODY

[75] Inventors: Tsuyoshi Kageyama, c/o Yokohama Branch, Kajima Corporation, 51, Otamachi 4-chome, Naka-ku, Yokihama, Kanagawa, 231; Hisashi Ishimura; Mitsuya Uchida, both of Tokyo, all of Japan

[73] Assignees: Tsuyoshi Kageyama, Kanagawa; Federation of Kajima Construction Industry Associations; Prop Co., Ltd., both of Tokyo, all of Japan

[21] Appl. No.: 08/980,233

[22] Filed: Nov. 28, 1997

[30] Foreign Application Priority Data

Dec. 26, 1996 [JP] Japan ..... H 8-348897

[51] Int. Cl.[6] ..... A41D 13/00

[52] U.S. Cl. ..... 2/69; 2/455; 2/DIG. 3

[58] Field of Search ..... 2/69, 79, 1, 455, 2/456, 459–467, DIG. 3

[56] References Cited

U.S. PATENT DOCUMENTS

| | | | |
|---|---|---|---|
| 4,059,852 | 11/1977 | Crane | 2/DIG. 3 X |
| 4,637,074 | 1/1987 | Taheri | 2/DIG. 3 X |
| 4,685,151 | 8/1987 | Kincheloe | 2/DIG. 3 X |
| 4,977,623 | 12/1990 | DeMarco | 2/69 |
| 5,091,992 | 3/1992 | Pusic | 2/DIG. 3 X |
| 5,133,084 | 7/1992 | Martin | 2/DIG. 3 X |
| 5,259,070 | 11/1993 | De Roza | 2/DIG. 3 X |
| 5,402,535 | 4/1995 | Green | 2/DIG. 3 X |
| 5,500,952 | 3/1996 | Keyes | 2/DIG. 3 X |
| 5,535,446 | 7/1996 | Pusic | 2/DIG. 3 X |
| 5,781,936 | 7/1998 | Alaloof | 2/456 |

FOREIGN PATENT DOCUMENTS

| | | | |
|---|---|---|---|
| 2499373 | 8/1982 | France | 2/DIG. 3 |
| 3616890 | 11/1987 | Germany | 2/DIG. 3 |
| 4106292 | 12/1991 | Germany | 2/DIG. 3 |
| 7-197754 | 8/1995 | Japan . | |
| 1479733 | 7/1977 | United Kingdom | 2/DIG. 3 |
| 1588919 | 4/1981 | United Kingdom | 2/DIG. 3 |
| 2223395 | 4/1990 | United Kingdom | 2/DIG. 3 |

*Primary Examiner*—Gloria Hale

*Attorney, Agent, or Firm*—Lowe Hauptman Gopstein Gilman & Berner

[57] ABSTRACT

The present invention provides a shock absorbing aid for a human body ensuring an effective alleviation of a shock to the human body. In the present invention, air bags are inflated upon a detection of separation of a wearer's body from an object of contact, such as when the wearer has fallen from an aerial place, thereby making it possible to absorb a shock to the human body with the aid of the air bags even when the wearer has directly dropped on the ground or the like.

7 Claims, 7 Drawing Sheets

SHOCK ABSORBING AID FOR HUMAN BODY

BACKGROUND OF THE INVENTION

1. Field of the Invention

The present invention relates generally to a shock absorbing aid for human body intended to protect the human body upon a fall from an aerial working place such as an construction site.

2. Description of the Related Art

In the case of working at aerial areas such as construction sites, it is common to wear a safety belt having a rope with which the human body is linked to the structure side in the working space. A safety net is also sometimes provided beneath the working place to catch a fallen worker.

For the safety belt, however, there was a possibility of failing to engage a hook of the rope with the structure side or a possibility of inadvertently falling as when the hook is temporarily disengaged upon a movement through the working space. Also, irrespective of the presence of the safety net, the worker will not necessarily fall into the net. In any event, when the worker has dropped directly on the ground or the like, it was difficult to protect the human body from the shock upon the drop.

SUMMARY OF THE INVENTION

The present invention was conceived in view of the above problems. It is therefore the object of the present invention to provide a shock absorbing aid for a human body ensuring an effective alleviation of shock to the human body.

According to a first aspect of the present invention, in order to achieve the above object, there is provided a shock absorbing aid for human body comprising a wear member to be carried on a human body; a plurality of air bags disposed on the wear member at predetermined positions; a plurality of inflation means for inflating the plurality of air bags; a plurality of detection means for detecting a contact of a wearer's body with objects of contact; and control means for activating the inflation means for the air bags when the detection means detect that the wearer's body has separated from the objects of contact. This configuration will allow the air bags to be inflated upon the detection of a separation of the wearer's body from the objects of contact, thereby making it possible to absorb shock to the human body with the aid of the air bags even when the wearer has dropped directly on the ground or the like. In this case, the inflation means for the air bags may be activated upon the elapse of a predetermined time after the detection of a separation of the wearer's body from the objects of contact, thereby preventing a malfunction in the case e.g., where both feet have been simultaneously brought away from the scaffold in ordinary walking.

According to a second aspect of the present invention, also as disclosed in Japanese Patent Laid-open Pub. No. 9-38228 which was filed by the present applicant and the disclosure of which is incorporated herein by reference, there is provided a shock absorbing aid for human body intended to be carried on a worker working at an aerial place, comprising a wear member to be carried on the body of the worker; a plurality of air bags disposed on the wear member at predetermined positions; a plurality of inflation means for inflating the plurality of air bags; a plurality of detection means for detecting a contact of a wearer's body with objects of contact; and control means for activating the inflation means for the air bags upon the elapse of a predetermined time after the detection of a separation of the wearer's body from the objects of contact by the detection means. This configuration will allow the air bags to be inflated upon the elapse of a predetermined time after the detection of a separation of the wearer's body from the objects of contact as when the wearer has fallen from an aerial place such as a construction site, thereby making it possible to absorb shock to the human body with the aid of the inflated air bags even when the wearer has dropped directly on the ground or the like. In the above configuration, the detection means are preferably comprised of a plurality of pressure detection means disposed at positions corresponding to both feet and buttocks of the wearer. This will enable contact of the wearer's both feet and buttocks with the objects of contact to be detected from the wearer's own weight, thus ensuring a secure detection of separation of the wearer from the objects of contact.

BRIEF DESCRIPTION OF THE DRAWINGS

The above and other objects, aspects, advantages and features of the present invention will become more apparent from the following description when read in conjunction with the accompanying drawings, in which.

DESCRIPTION OF THE PREFERRED EMBODIMENTS

Figure 1A:
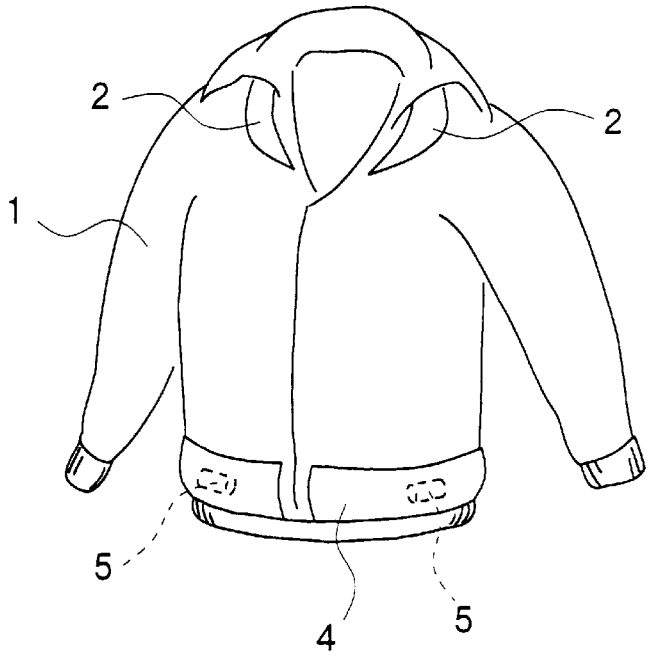
FIGS. 1A and 1B are perspective views of an embodiment of a shock absorbing aid for human in accordance with the present invention, when viewed from front and rear sides thereof, respectively.

FIGS. 1 to 7 illustrate an embodiment of the present invention. A shock absorbing aid for a human body of this embodiment comprises work clothes 1 in the form of a wear member to be carried on the human body; air bags 2, 3 and 4 disposed on the work clothes 1 at a plurality of positions thereof; a plurality of gas cans 5 for inflating the air bags; a plurality of pressure sensors 6 for detecting a pressure of the weight of a person carrying the aid; and a control unit 7 causing the air bags 2, 3 and 4 to be inflated in response to a detection signal from the pressure sensor 6.

Figure 1B:
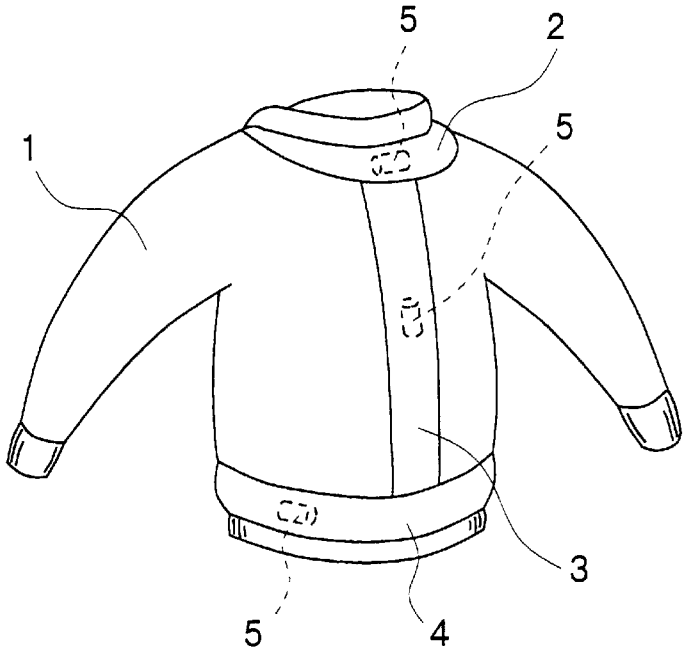
Figure 6:
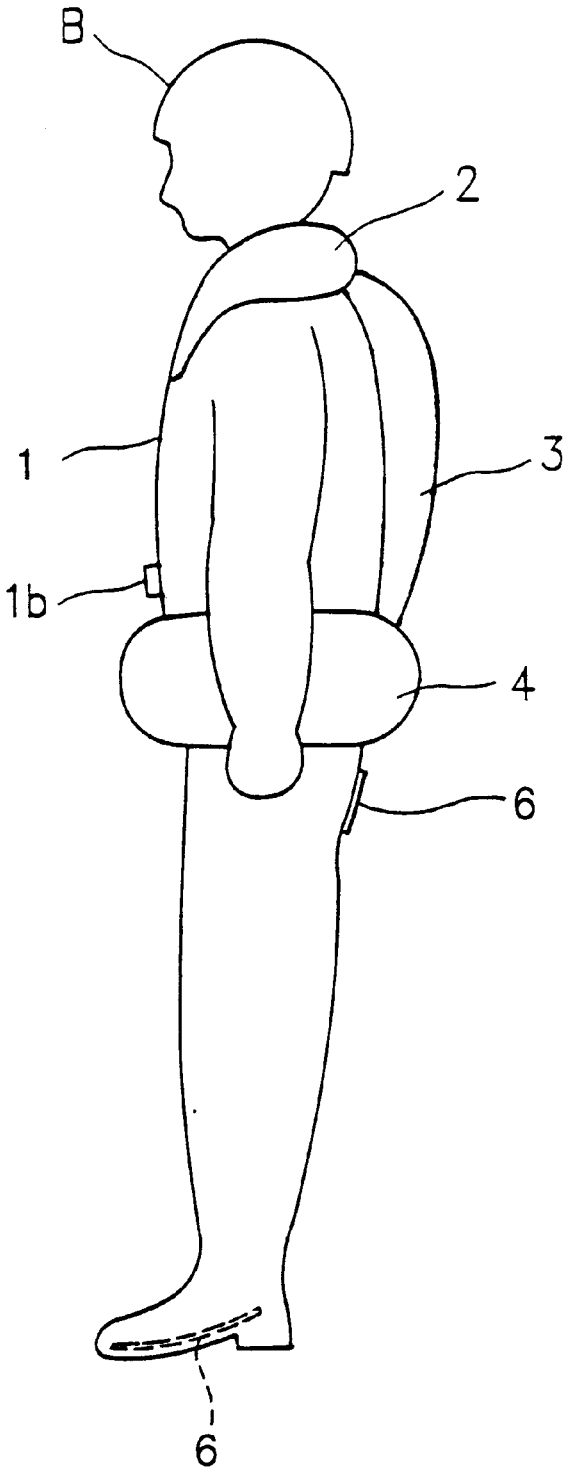
FIG. 6 is a side elevational view showing inflated air bags.

The work clothes 1 include a jacket and pants, as is apparent from FIGS. 1A and 1B which illustrate respectively front and rear sides of the jacket as well as FIG. 6. Referring in particular to FIG. 6, the work clothes 1 are fitted with a control box 1*b* which accommodates an ON/OFF switch, a power source, a micro computer, etc.

The air bags 2, 3 and 4 are made of e.g., airproof cloths by sewing and are deflated in their non-inflated state to substantially the same thickness as that of the work clothes 1 for receiving therewithin. The air bags 2, 3 and 4 are disposed at positions corresponding to the neck, back and waist of the human body and are provided integrally with the work clothes 1. More specifically, the air bag 2 at the neck extends annularly around the neck so as to cover the neck except its front portion, the air bag 3 at the back extends vertically along the back so as to cover the center of the back in a planar manner, and the air bag 4 at the waist extends horizontally around the waist so as to cover the circumference of the waist in a belt-like manner. In this case, the air bags 2, 3 and 4 may be placed in fluid communication with one another.

Figure 2:
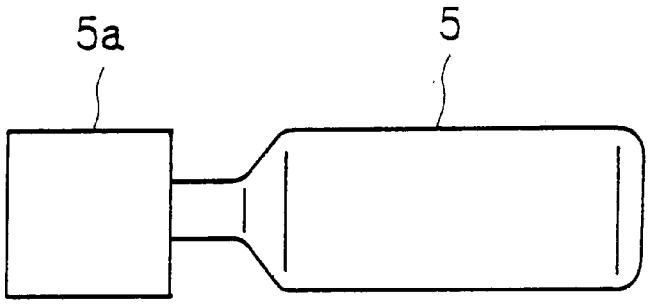
FIG. 2 is a side elevational view of a gas can for use in air bags.

The gas cans 5 are filled with a high-pressure gas and are housed within the air bags 2, 3 and 4. As shown in FIG. 2, each gas can 5 has at its extremity a releaser 5*a* serving to release a discharge port of the gas can 5. The releaser 5*a* is adapted to release a stopper of the discharge port by an explosion of powder, and is provided with an igniter causing the powder to explode in response to an activating signal from the control unit 7. It is to be noted that the gas cans 5 may be positioned partly in the air bags 2, 3 and 4 in the case where the air bags 2, 3 and 4 are placed in fluid communication with one another.

Figure 3:
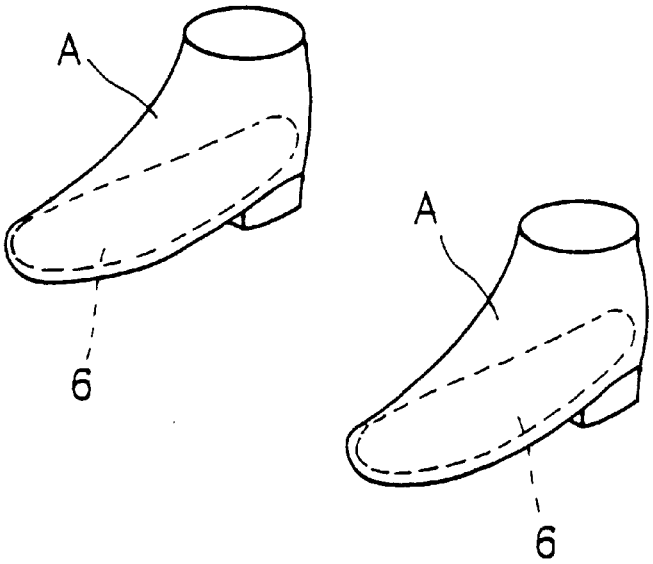
FIG. 3 is a perspective view of shoes each fitted with a pressure sensor.
Figure 4:
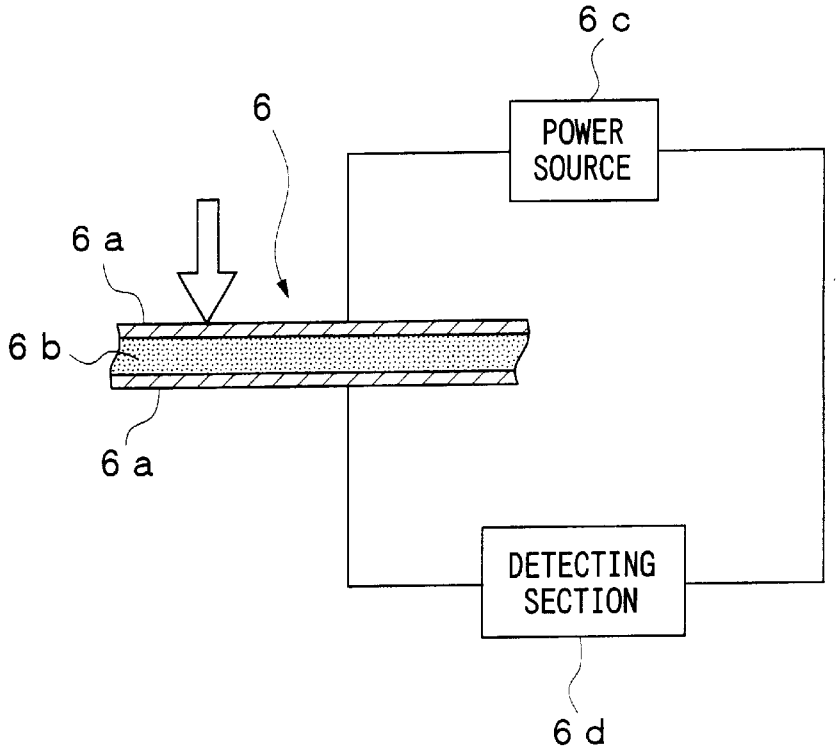
FIG. 4 is a diagram showing a configuration of the pressure sensor including a detection unit.

Referring to FIGS. 3 and 6, the pressure sensors 6 are disposed within both shoes A of a wearer and at positions corresponding to buttocks of the work clothes 1, each sensor 6 being of planar surfaces. As shown in FIG. 4, the pressure sensors 6 each include a pair of planar electrodes 6*a* and a known pressure-sensitive electrically conductive rubber 6*b* sandwiched between the pair of electrodes 6*a*. The pair of electrodes 6*a* are respectively associated with a power source 6*c* for applying a predetermined voltage and with a detecting section 6*d* for detecting a current between the pair of electrodes 6*a*. When the weight of a worker applies a pressure to the pressure sensors 6, the pressure-sensitive electrically conductive rubber 6*a* is compressed to lower its resistivity, allowing the value of current detected in the detecting section 6*d* to be raised. The pressure sensors 6 are each connected to the control box 1*b* by way of lead wires or the like not shown.

Figure 5:
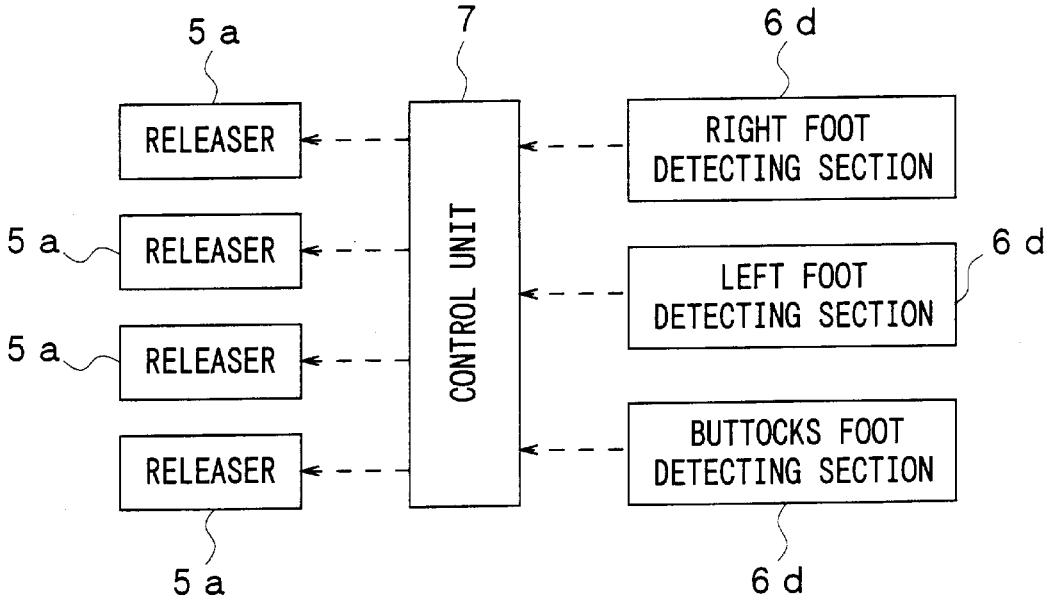
FIG. 5 is a block diagram of a control system.

The control unit 7 is comprised of a micro computer including an integrated circuit or an electronic circuit and, as shown in FIG. 5, is connected to the releasers 5*a* of the gas cans 5 and to the detecting sections 6*d* of the pressure sensors 6.

In the thus configured shock absorbing aid for human body, if a wearer B with the work clothes 1 falls inadvertently from an aerial place, the pressure sensors 6 of the shoes A and work clothes 1 of the wearer B detect that both feet and buttocks of the wearer B have come off scaffolds which are objects of contact, whereupon the releasers 5*a* of the gas cans 5 are activated in response to the activating signals from the control unit 7, allowing a high-pressure gas to be discharged from the gas cans 5. As a result of this, as shown in FIG. 6, the air bags 2, 3 and 4 are inflated to thereby absorb a drop impact to the human body even though the wearer B has directly dropped on the ground or the like.

Figure 7:
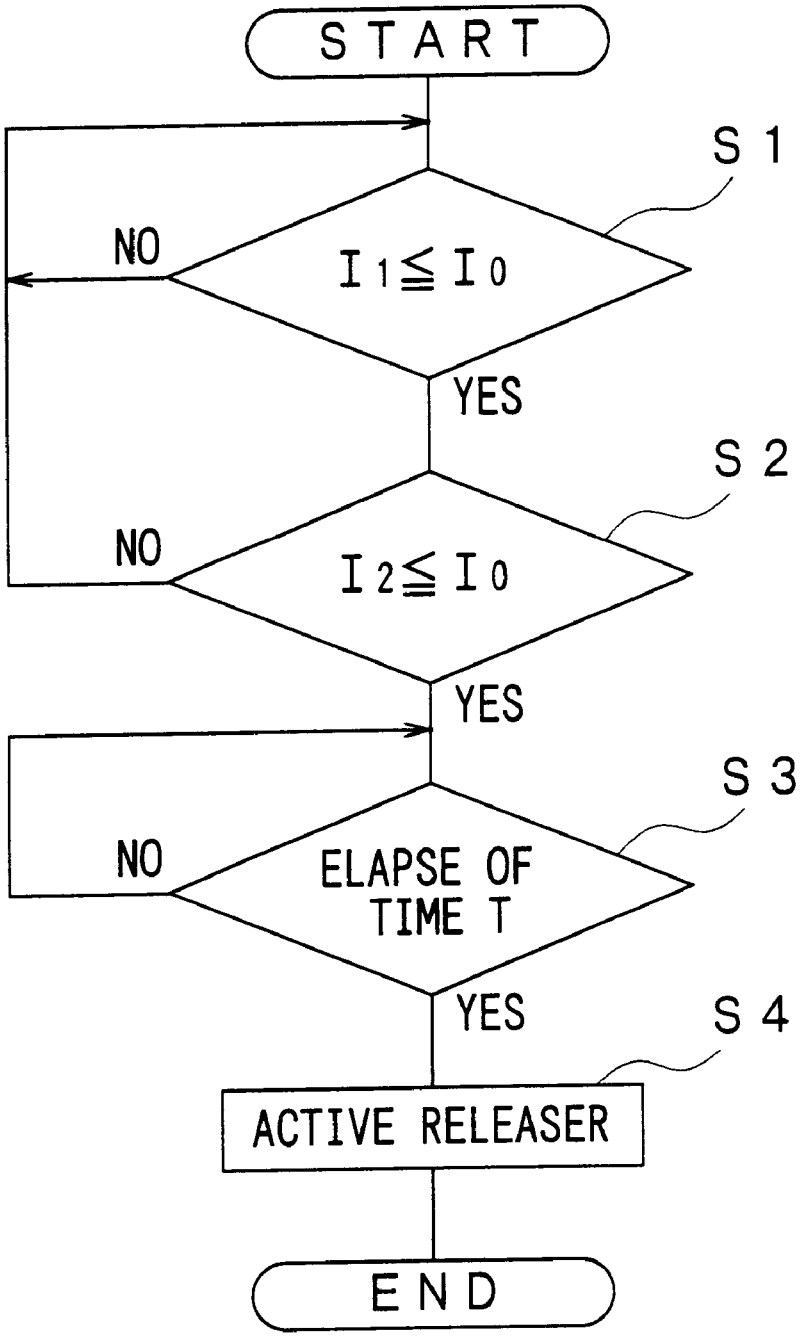
FIG. 7 is a flow chart showing actions of the control unit.

Reference is now made to FIG. 7 which is a flow chart of procedures to be executed by the control unit 7. Let I0, I1 and I2 be a value of current detected in the detecting sections 6*d* when no pressure is applied to the pressure sensors 6, a value of current detected in the detecting sections 6*d* at the buttocks, and a value of current detected in the detecting sections 6*d* at both feet, respectively. When both I1 and I2 become not more than I0 (steps S1 and S2) and a predetermined time T (e.g., 0.1 sec.) has elapsed (S3), the releasers 5*a* of the gas cans 5 are activated (S4). In this case, the time T is set to prevent a malfunction which may take place when the worker's both feet are simultaneously brought away from the scaffold in ordinary walking. It is to be appreciated that the pressure sensor 6 is provided also at the positions corresponding to the buttocks of the work clothes 1 in order to prevent a malfunction which may take place when both feet of the wearer B are spaced apart from the scaffold in his sitting posture.

Thus, according to the shock absorbing aid for human body of this embodiment, the work clothes 1 to be carried on a human body include a plurality of air bags 2, 3 and 4 which are inflated by a high-pressure gas the instant it is detected that both feet and buttocks of a wearer B have been brought away from the scaffold in case of a fall of the wearer B, thereby making it possible to absorb a shock upon the fall even when the wearer B has fallen directly on the ground or the like. Furthermore, the pressure sensors 6 are disposed in shoes A of the wearer B and at positions corresponding to buttocks of the work clothes 1 so that there can be detected contacts of both feet and buttocks of the wearer B with the scaffold by the weight of the wearer B, thereby ensuring a secure detection of a separation of the wearer B from the scaffold.

A safety belt is used in principle at an aerial place in a construction side and therefore may be formed integrally with the above-described work clothes 1. In this case, detection means may be provided which detects a coupling of a safety belt hook with a structure side, so that the air bags 2, 3 and 4 can be activated when the pressure sensors 6 have detected a separation of the wearer B from the scaffold and simultaneously when the detection means have detected a release of the coupling of the hook with the structure side, thereby achieving more effective prevention of malfunction. In this case, air bags may be provided on the safety belt serving as a wear member to be carried on the human body. The shock absorbing aid for human body of the present invention can also be used for not only aerial work applications but riders on vehicles such as motorcycles.

Figure 8:
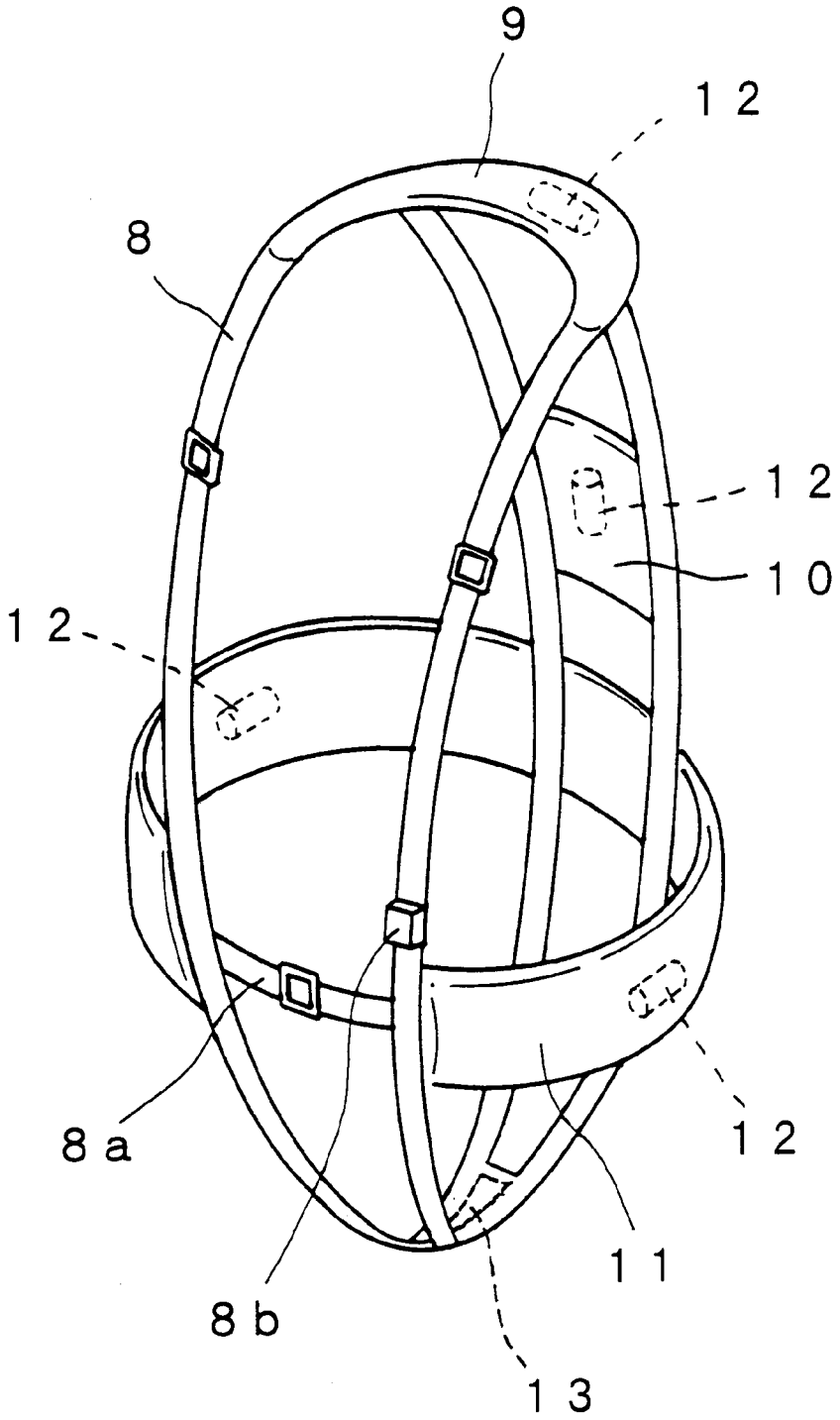
FIG. 8 is a perspective view of another embodiment of the shock absorbing aid for human body in accordance with the present invention.
Figure 9:
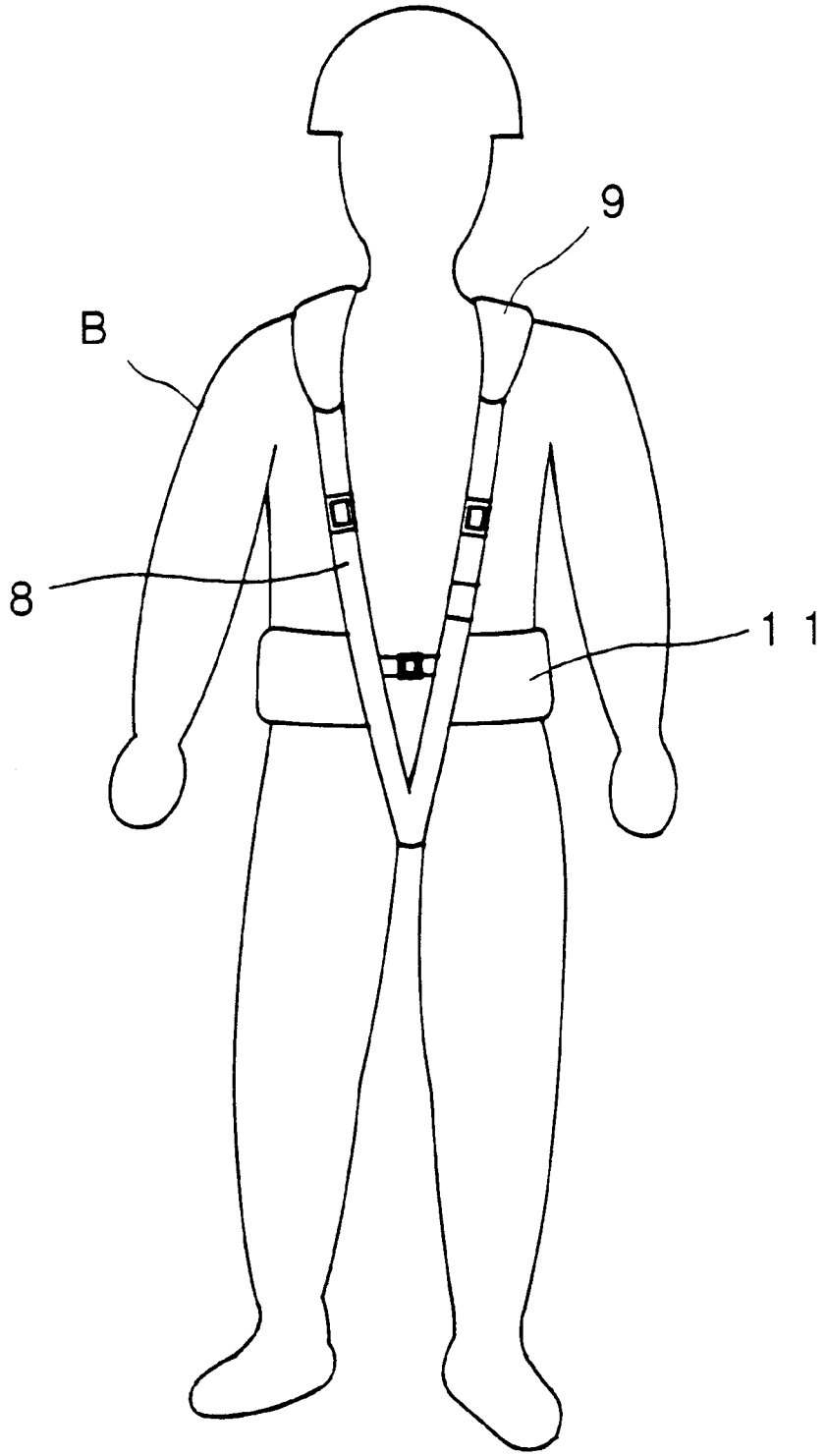
FIG. 9 is a front elevational view showing the shock absorbing aid of FIG. 8 fitted to a human body.

Referring to FIGS. 8 and 9, there is depicted another embodiment of the present invention in which the wear member is in the form of a belt. The wear belt is generally designated at 8 and includes two belts extending from both shoulders to the crotch and adapted to be coupled together at the front by means of a belt 8*a*. The wear belt 8 is fitted with a control box 8*b* in the same manner as the above embodiment, with air bags 9, 10 and 11 disposed at the positions corresponding to the neck, back and waist of the human body. A plurality of gas cans 12 are housed within the air bags 9, 10, 11 and serve to inflate the associated air bags 9, 10, 11 when pressure sensors 13 detect a separation from objects of contact in the same manner as the above embodiment, the pressure sensors 13 being disposed at positions corresponding to buttocks of the wear belt 8 and within the interior of both shoes.

Although the present invention has been described in connection with the certain preferred embodiments, it should be clear that various changes and modifications can be made without departing from the spirit and scope of the claimed invention.

What is claimed is:

1. A shock absorbing aid for human body comprising:

a wear member to be carried on a human body;

a plurality of air bags disposed on said wear member at predetermined positions;

a plurality of inflation means for inflating said plurality of air bags;

a plurality of detection means for detecting contact of a wearer's body with objects of contact, said detection means including a plurality of pressure detection means disposed at positions corresponding to both feet and buttocks of said wearer; and control means for activating said inflation means for said air bags when said detection means detect that said wearer's body has separated from said objects of contact.

2. A shock absorbing aid for human body comprising:

a wear member to be carried on a human body;

a plurality of air bags disposed on said wear member at predetermined positions;

a plurality of inflation means for inflating said plurality of air bags;

a plurality of detection means for detecting contact of a wearer's body with objects of contact, said detection means being at positions corresponding to both feet and being arranged within shoes of said wearer, and control means for activating said inflation means for said air bags when said detection means detects that said wearer's feet have separated from said objects of contact.

3. A shock absorbing aid for human body intended to be carried on a worker working at an aerial place, comprising:

a belt to be carried on the body of said worker;

a plurality of air bags disposed at predetermined positions on said belt;

a plurality of inflation means for inflating said plurality of air bags;

a plurality of detection means for detecting contact of a wearer's body with objects of contact; and control means for activating said inflation means for said air bags upon the elapse of a predetermined time after the detection by said detection means of a separation of said wearer's body from said objects of contact.

4. A shock absorbing aid for human body comprising:

a wear member to be carried on a human body;

a plurality of air bags disposed on said wear member at predetermined positions;

a plurality of inflation means for inflating said plurality of air bags;

a plurality of detection means for detecting contact of a wearer's body with objects of contact, said detection means including a plurality of pressure detection means disposed at positions corresponding to both feet and buttocks of said wearer; and control means for activating said inflation means for said air bags upon the elapse of a predetermined time after the detection by said detection means of a separation of said wearer's body from said objects of contact.

5. A shock absorbing aid for human body intended to be carried on a worker working at an aerial place, comprising:

a wear member to be carried on the body of said worker;

a plurality of air bags disposed on said wear member at predetermined positions;

a plurality of inflation means for inflating said plurality of air bags;

a plurality of detection means for detecting contact of a wearer's body with objects of contact, said detection means including a plurality of pressure detection means disposed at positions corresponding to both feet and buttocks of said wearer; and control means for activating said inflation means for said air bags upon the elapse of a predetermined time after the detection by said detection means of a separation of said wearer's body from said objects of contact.

6. A shock absorbing aid for human body comprising:

a wear member to be carried on a human body;

a plurality of air bags disposed on said wear member at predetermined positions;

a plurality of inflation means for inflating said plurality of air bags;

a plurality of detection means for detecting contact of a wearer's body with objects of contact, said detection means being at positions corresponding to both feet and being arranged within shoes of said wearer; and control means for activating said inflation means for said air bags upon the elapse of a predetermined time after the detection of a separation of said wearer's body from said objects of contact by said detection means.

7. A shock absorbing aid for human body intended to be carried on a worker working at an aerial place, comprising:

a wear member to be carried on the body of said worker;

a plurality of air bags disposed on said wear member at predetermined positions;

a plurality of inflation means for inflating said plurality of air bags;

a plurality of detection means for detecting contact of a wearer's body with objects of contact, said detecting means being at positions corresponding to both feet and being arranged within shoes of said wearer; and control means for activating said inflation means for said air bags upon the elapse of a predetermined time after the detection of a separation of said wearer's body from said objects of contact by said detection means.

* * * * *